US012185783B1

(12) United States Patent
Searcy et al.

(10) Patent No.: US 12,185,783 B1
(45) Date of Patent: Jan. 7, 2025

(54) DEVICE AND METHOD FOR DETERMINING GARMENT SIZE

(71) Applicant: BOSOM'D LLC, Franktown, CO (US)

(72) Inventors: Paula Searcy, Franktown, CO (US); Joseph Searcy, Franktown, CO (US)

(73) Assignee: BOSOM'D LLC, Franktown, CO (US)

( * ) Notice: Subject to any disclaimer, the term of this patent is extended or adjusted under 35 U.S.C. 154(b) by 0 days.

(21) Appl. No.: 18/744,490

(22) Filed: Jun. 14, 2024

(51) Int. Cl.
*A41H 1/02* (2006.01)

(52) U.S. Cl.
CPC ..... *A41H 1/02* (2013.01)

(58) Field of Classification Search
CPC ..... A41H 1/02
See application file for complete search history.

(56) References Cited

U.S. PATENT DOCUMENTS

| | | | | | |
|---|---|---|---|---|---|
| 1,784,888 | A * | 12/1930 | Couture | A41H 1/02 | 33/15 |
| 1,935,998 | A * | 11/1933 | Strading | A41H 1/02 | 33/15 |
| 2,946,125 | A * | 7/1960 | Gittelson | A41H 1/02 | 450/64 |
| 4,635,367 | A * | 1/1987 | Vigede | A41H 1/02 | 33/15 |
| 5,965,809 | A | 10/1999 | Pechter | | |
| 6,272,761 | B1 | 8/2001 | Pechter | | |
| 6,467,180 | B1 | 10/2002 | Chan | | |
| 7,249,423 | B2 * | 7/2007 | Sieber | A41H 1/02 | 33/3 C |
| 7,685,727 | B2 * | 3/2010 | Sieber | G01B 3/10 | 33/3 C |
| 7,905,028 | B2 * | 3/2011 | Sieber | A41H 1/02 | 33/3 C |
| 8,763,262 | B2 * | 7/2014 | Smith-Habelow | A41H 1/02 | 33/756 |
| 8,832,955 | B2 | 9/2014 | Petter et al. | | |
| 9,568,296 | B2 * | 2/2017 | Moore | A61B 5/4312 | |
| 10,973,271 | B2 * | 4/2021 | D'Antonio | G01B 3/1061 | |
| 2008/0184575 | A1 * | 8/2008 | Sieber | G01B 3/10 | 33/512 |
| 2015/0089824 | A1 * | 4/2015 | Moore | A41H 1/02 | 33/512 |

* cited by examiner

*Primary Examiner* — Yaritza Guadalupe-McCall
(74) *Attorney, Agent, or Firm* — Fennemore Craig, P.C.

(57) ABSTRACT

Described herein are devices and methods for using the devices for taking measurements of an individual person's body for the purpose of determining the correct size of a bra and other garments, and methods for using the devices. The device is used to easily and accurately determine the specific size of bra or other garment that will suit a person's body, by measuring the band size, cup size, and breast root width size for the person. The device may be used to measure other parts of the body. The devices are especially useful for a person to take their own measurements with ease and accuracy.

17 Claims, 6 Drawing Sheets

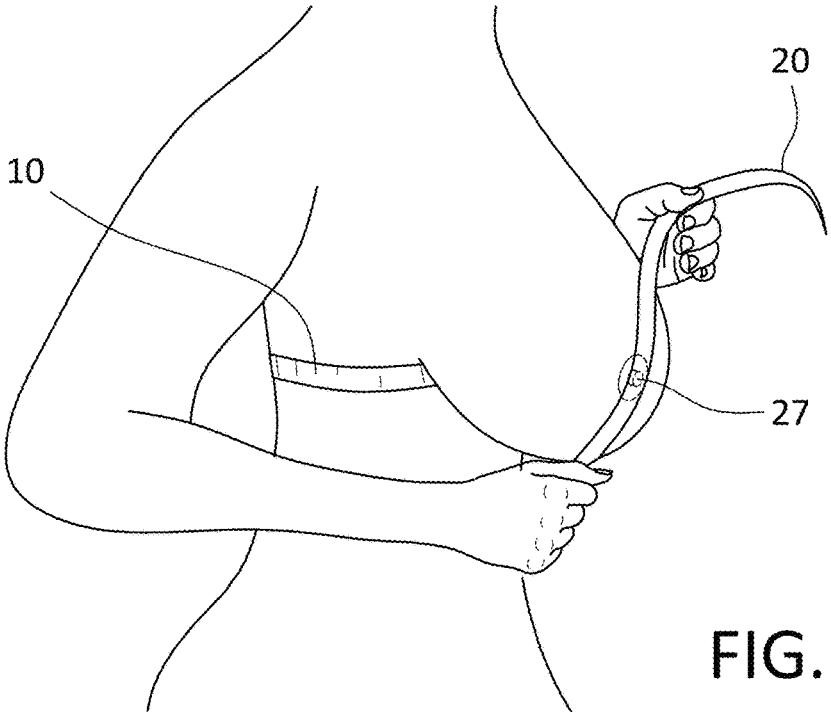
FIG. 4A
FIG. 4B
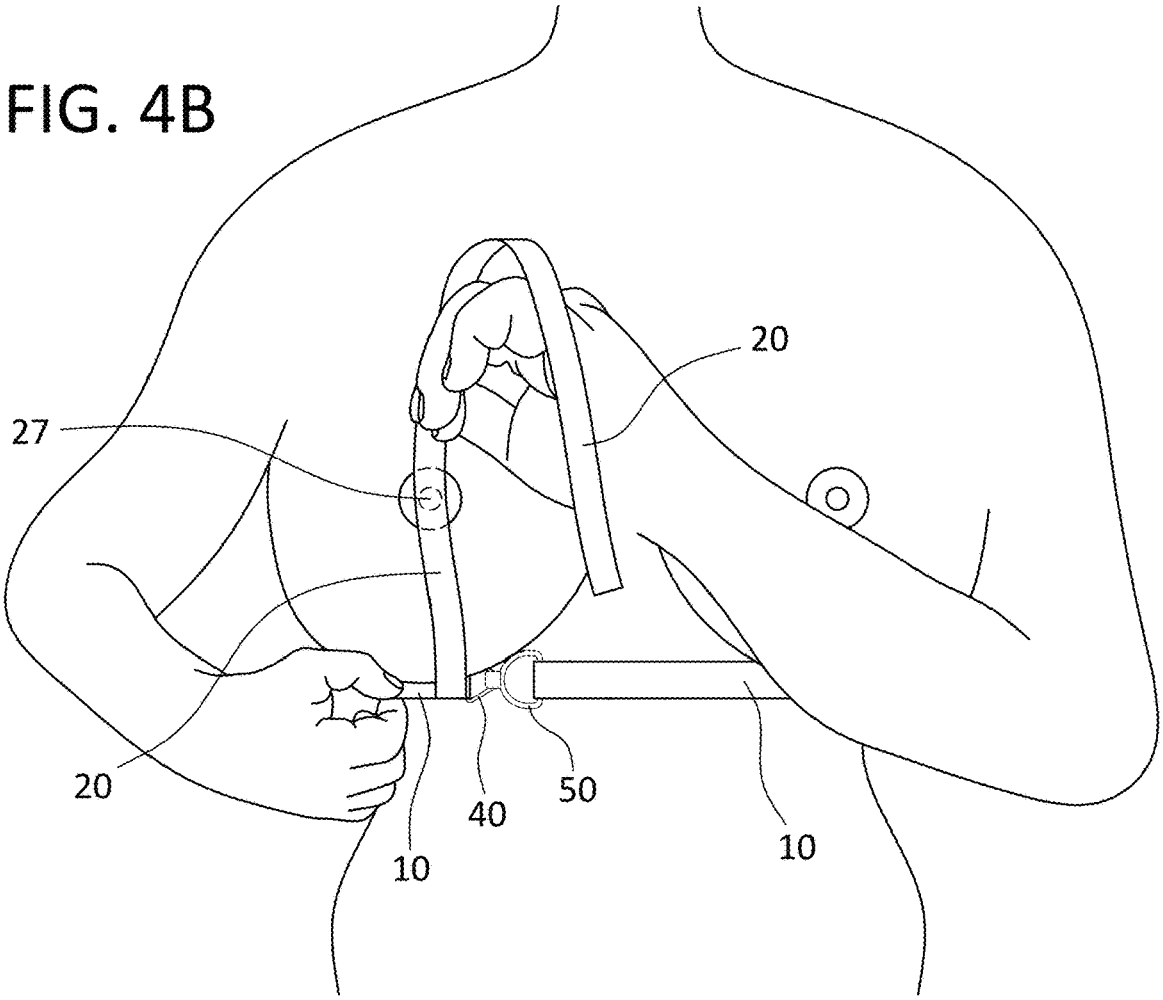

DEVICE AND METHOD FOR DETERMINING GARMENT SIZE

FIELD OF THE INVENTION

The present invention relates to the field of measuring and testing devices. More specifically, it relates to the field of measuring a person to determine the correct size of a garment for the person.

BACKGROUND OF THE INVENTION

Garments are increasingly being purchased online, and consumers, retailers, and manufacturers have long sought a way to accurately determine the consumer's garment size before the consumer makes a purchase, thereby increasing the chances that the garment will properly fit the consumer and therefore will not be returned to the retailer or manufacturer.

SUMMARY OF THE INVENTION

Described herein are devices for taking measurements of various portions of an individual person's body. The devices may be used to obtain a person's measurements, and the measurements may be used for various purposes. A particular example of the use of the measurements is to determine the person's garment size, for any garments that are worn at least partially on the person's upper torso, such as swimsuits, lingerie, bras/brassieres, athletic wear, wedding dresses, gowns, jackets, blazers, etc. Of the many uses, one particular use for the devices is to obtain a person's measurements for the purpose of determining the correct size of a bra for that person to wear. Also described herein are methods for using the devices described herein. The devices are especially useful for a person to take their own measurements with ease and accuracy.

BRIEF DESCRIPTION OF THE DRAWINGS

FIGS. 4A and 4B illustrate a method of using an embodiment of the devices described herein to measure a person's breast cup size.

DETAILED DESCRIPTION OF THE INVENTION

Figure 1:
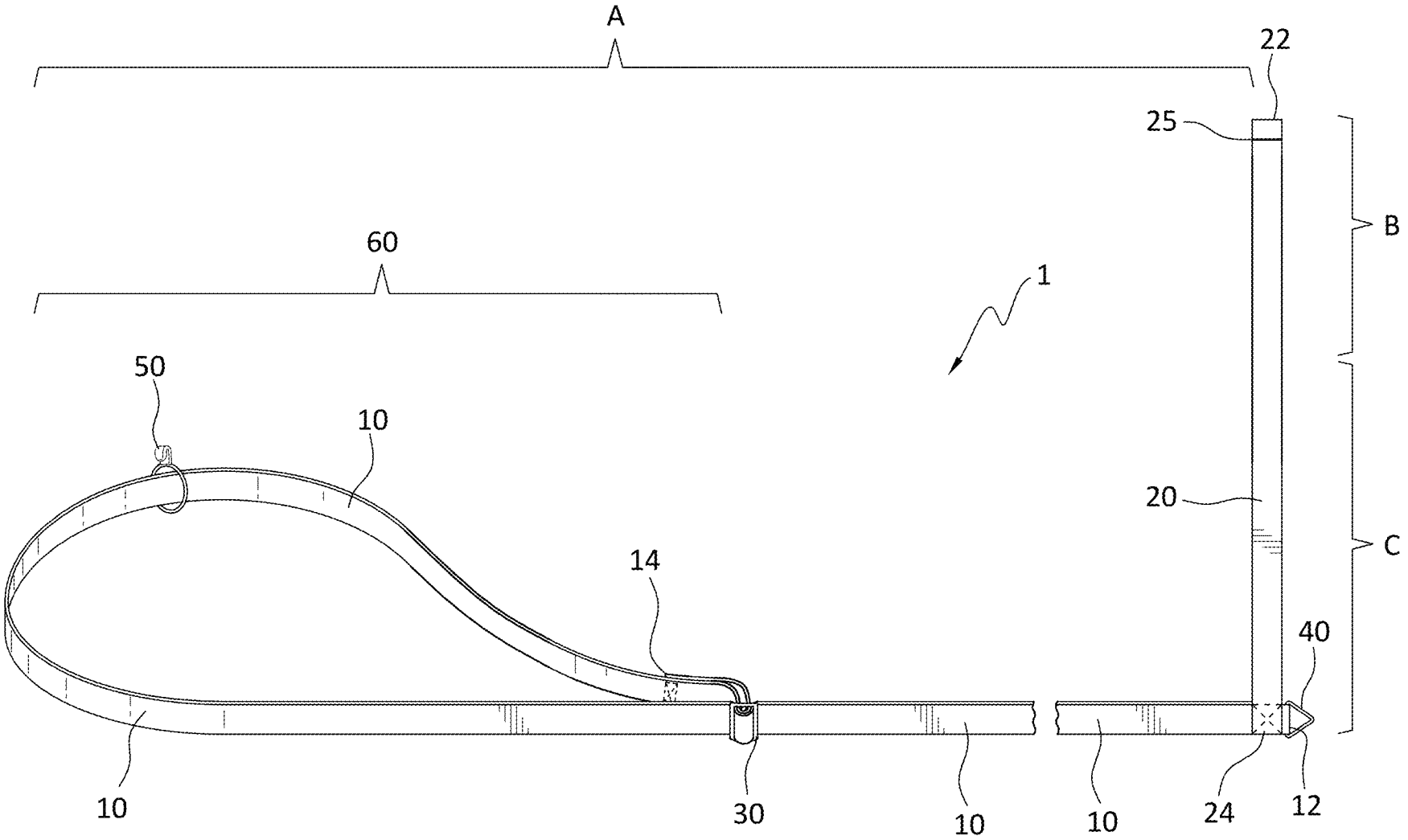
FIG. 1 is a front perspective view of an embodiment of the devices described herein, but does not show measurement indicia.

There are many types of garments that are intended to be worn on a person's body, and many garments are intended by their nature, and/or preferred by the person who wears the garments, to fit closely to the body, for aesthetic and/or functional reasons. However, it tends to be difficult to determine a person's precise size for garments and obtain a good fit, especially those garments that are intended or desired to be worn on in a closely-fitted manner on the person's upper body, and particularly if the person has breasts. This difficulty results from factors such as the variations between individual persons with respect to torso diameter and the size (volume), shape, height, orientation, and density of the breasts.

The aforementioned difficulty is particularly problematic when a person is attempting to find a bra that correctly fits, so that the bra can provide the aesthetic and functional benefits that a bra is intended to provide. In fact, it is quite common for individuals to wear an ill-fitting bra. This is due to numerous reasons, including difficulty measuring oneself, taking incorrect measurements, failing to obtain a bra-fitting by someone with expertise, etc. It is also quite problematic when attempting to determine a person's correct size for garments having built-in breast support, such as swimsuits, wedding dresses, etc. A garment that fits the person correctly is especially important in the case of strapless garments, which must stay in place on the person's body without the assistance of shoulder straps; if the strapless garment does not fit properly on the person's torso on the area including the breasts and ribcage and back, then the garment will not remain in place on the person, and may slip down and/or rotate undesirably on the person's body, causing discomfort and embarrassment.

In addition to the differences between individual persons with respect to the sizes, shapes, density, heights, and orientations of the breasts, the nature of breast tissue further complicates determining the correct size of bras, lingerie, swimsuits, and other garments. Breast tissue typically requires the support provided by bras and other garments, to counter the effects of gravity, to prevent the breasts from moving, sagging, drooping, lacking desirable shape, to avoid damage to breast tissue, and/or provide other aesthetic, comfort or health benefits.

At present, commercially available bras (as well as some swimsuits and other garments) are available in sizes based on band and cup size, e.g., 36C (wherein the band size is 36, and the cup size is C). However, although two people can have the same band and cup size measurements, one of them may find a particular manufacturer's model of bra to correctly and comfortably fit the person, yet the same bra is ill-fitting and uncomfortable on the other person. In other words, two persons may each wear a 36C size of the same brand and model, yet it is likely that the same bra will not fit correctly on one or both persons.

In fact, it is generally accepted that about 80% of bra-wearers are not wearing a correctly-fitting bra, primarily because they do not know how to determine their correct bra size and other reasons, including difficulty measuring oneself, taking incorrect measurements, failing to obtain a bra-fitting by someone with expertise, etc. Wearing a bra that is not correctly-sized can result in discomfort and pain to the wearer, and can have numerous other negative consequences for the wearer, such as poor posture and other health problems.

The aforementioned challenges have been addressed by an increase in the marketplace of bras that are nonstructural and composed of "stretchy" material and/or are provided with padding to lift the breasts, neither of which meet the needs of all persons, particularly those with larger breasts.

Described herein are devices and methods for a person to obtain measurements of the person's body. The measurements obtained can then be used by the person to find a bra or have a bra custom-made that will be well-fitting, comfortable, and functional. The measurements obtained can also be used by a person to find or have made other types of garments that are well-fitting, comfortable, and functional.

Devices and methods according to embodiments of the invention are discussed in detail herein with respect to determining bra size, but the devices and methods are not limited to bra sizes, but are also applicable for determining the correct size of other garments.

A bra is typically comprised of at least the following components:

- two cups in which the wearer's breasts are situated when the bra is worn;
- a bridge, sometimes referred to as a center front gore, situated between, or approximately between, each cup and providing a connection between the cups;
- a back band designed to traverse a wearer's back from the wearer's left side to the wearer's right side when a bra is worn;
- two side bands (each sometimes referred to as a "wing"), each side band designed to be situated approximately below each of the wearer's armpits when a bra is worn, and wherein each side band connects the cup adjacent to it to the bra's back band; optionally, the back band and side bands are a unitary structure, i.e., formed substantially of a single piece of fabric or other material (sometimes with an opening and closure mechanism in the back portion);
- an optional underband that is situated below the cups; the bottom or lower portion of each cup (and sometimes also the center front gore) may be connected to the underband; in some bras, the underband is comprised of an area defined by the bottom of each cup and the center front gore;
- optional shoulder straps, wherein each strap provides a connection between the uppermost portion, i.e., the apex, of one of the cups and the back band; and
- optional closure mechanism (typically hook and eye).

In addition, most bras have an underwire situated at the bottom and sides of each cup.

In order for a bra to properly fit a person so that it will be comfortable when worn, will not be deleterious to the person's health, and will provide the bra's intended benefits, it is very important that each of the following three components of the bra are of a proper, accurate size for that person: (1) the bra band encircling the wearer's torso, (2) the cups, and (3) the breast root width.

The "bra band" of a bra is the portion of the bra that encircles the wearer's torso at a point just at or immediately below where the skin of the breasts at the bottom of each breast expands from the wearer's torso. Thus, the bra band encircles or traverses the circumference of the wearer's entire torso and ribcage. The bra band is generally comprised of the back band, the side bands or wings, and the underband.

The cup size of a bra generally correlates to the volume of each breast. Although this is not how cup size is measured using the disclosed measurement devices, cup size had traditionally been measured on a person by taking a measurement at the circumference of the person's torso at a point where the breasts extend the farthest away from the torso (almost always this is at the nipples of the person's breasts), and the difference between that measurement and the band size measurement determines the person's cup size.

The traditional, typical way that a person's bra size is currently determined, and the typical size ranges of bras available for purchase, is by a combination of band size and cup size (e.g., 36C, 38C, 38D, etc., wherein "36C" indicates band size 36 and cup size C). The traditional, prior art sizing methodology fails to take into consideration other variations in persons' bodies that effect the fit of bras, lingerie, swimsuits, and other garments.

The breast root area has generally not been considered when bras are manufactured and offered for sale, and to the inventors' knowledge, commercially available bras are not sized and available for specific breast root measurements. The breast root is the area on the torso where the breast is attached, and is the area on the torso that is occupied by the breast. If a person's breasts droop or hang so that the breasts touch the torso, the part where the drooping/hanging breast touches the torso is not part of the breast root. The breast root size may be different for each breast on an individual person. The breast root area is primarily defined by a substantially "U" shaped portion of a person's body, starting at where the breast begins on the cleavage side of the breast (i.e., at a substantially central point on the front torso, between the breasts), extending below the breast where the breast meets the torso, and ending where the breast ends approximately under the person's arm or armpit. Breast root width is determined by measuring the width of the "U". Measuring the breast root width of each breast may be useful to determine what size underwire should be used in a bra or other garment, in order to correctly fit a particular person, and can be useful for other purposes, regardless of whether an underwire is involved. For example, determining a person's breast root width measurements provides information regarding various proportions or ratios of the person's body, such as the ratio between the person's breasts and the person's torso circumference.

The devices disclosed herein are useful for a person to quickly and accurately measure not just band size and cup size, but to measure three key areas of the person's upper body: bra band size, cup size, and breast root width size, thereby enabling the person to determine the specific size of garment, especially a bra, that will suit the person's body and provide the garment's or the bra's intended benefits, whether or not the bra or garment contains an underwire. The devices disclosed herein simple to operate, and yet provide accurate results, whether a person is measuring themself or a person is measuring another person.

Heretofore there has been no prior art device that provides a simple and effective way to quickly and accurately measure a person's bra band, cup size, and breast root width, let alone a way for a person to quickly and accurately measure these portions of the person's own body.

The devices described herein can also be used to accurately measure other areas of a person's body. Nonlimiting examples of areas of a person's body that may be measured by the devices include the circumference of the person's hips, the circumference of the person's waist, the length of the person's torso, the longitudinal circumference of the person's torso, the length of the person's leg, the person's inseam, etc. As used herein, the term "longitudinal circumference" means a measurement taken from the base of a person's neck (where it meets the shoulder on one side) across the front of the body, across the crotch and back up to the base of the neck. Obtaining accurate measurements of a person's hips and/or waist will be a significant aid in determining the correct size of certain garments that are not necessarily worn on the upper torso, such as panties, briefs, swimwear bottoms, etc. Obtaining accurate measurements of the length of the torso and/or of the longitudinal circumference of the torso will be a significant aid in determining the correct size of one-piece bathing suits, body suits, jumpsuits, etc.

The devices described herein provide a simple, efficient way for a person to accurately measure various portions of the person's body using a single device, and without assistance from another person. As a result, a person can quickly and accurately measure themself, alone in the privacy of the person's home or other place, and optionally use those measurements to purchase well-fitting bras and panties, swimsuits, evening gowns, and other garments. This is a significant advantage, because a person can take their own measurements without the potential embarrassment of having another individual measure them. The ability to accurately take one's own measurements is essential for a person who lives alone or does not otherwise have another suitable person to assist them. Other advantages include doing away with the need to leave one's home to be measured, thereby permitting the person to online order well-fitting, ready-made bras and other garments, as well as custom bras and other custom garments.

The devices described herein may also be used by a first person to quickly and accurately measure a second person.

The devices described herein will significantly increase the number of persons who will be able to wear bras and other garments that correctly fit them.

The devices described herein are further described with reference to the drawing figures, the devices comprising:

- a first measuring strap 10 having a first end 12, a second end 14, first measurement indicia 18, a loop 60 formed by a holding member 30 disposed on first measuring strap 10;
- a first complementary interlocking member 40 at first end 12;
- a second measuring strap 20 having a first end 22, a second end 24, a guide line 25, measurement indicia 26, and measurement indicia 28; and
- a second complementary interlocking member 50 moveably disposed on said first measuring strap 10;
- wherein the first end 12 of said first measuring strap 10 and the second end 24 of said second measuring strap 20 are attached together at a substantially 90 degree angle relative to one another.

In addition, the first complementary interlocking member 40 and the second complementary interlocking member 50 are capable of interlocking with one another. Further, the circumference of loop 60 may be increased or decreased by sliding holding member 30 along strap 10. By increasing the circumference of loop 60, the length of strap 10 increases, and by decreasing the circumference of loop 60, the length of strap 10 decreases.

In a more specific embodiment of the devices described herein, the following describes an embodiment of the devices described herein for measuring a person's bra size, wherein the devices comprise:

- a band measuring strap 10 having a first end 12, a second end 14, band measurement indicia 18, a loop 60 formed by a holding member 30 disposed on first measuring strap 10, and a first complementary interlocking member 40 at first end 12;
- a cup and breast root width wire measuring strap 20 having a first end 22, a second end 24, a guide line 25, cup measurement indicia 26, and breast root width measurement indicia 28; and
- a second complementary interlocking member 50 moveably disposed on said band measuring strap 10;
- wherein the first end 12 of band measuring strap 10 and the second end 24 of said cup and breast root width measuring strap 20 are attached together at a substantially 90 degree angle relative to one another.

In the aforementioned embodiment, the first complementary interlocking member 40 and the second complementary interlocking member 50 are capable of interlocking with one another, and the circumference of loop 60 may be increased or decreased by sliding holding member 30 along strap 10.

In yet another embodiment, measuring strap 20 comprises two overlapping straps, referred to as strap 200 and strap 201. Straps 200 and 201 each have a first end and a second end, and the second end of each is attached at a substantially 90 degree angle relative to strap 10. Straps 200 and 201 may be of different lengths. In one embodiment, strap 200 has a longer length than strap 201, and more preferably, strap 200 is used to measure cup, and strap 201 has a breast width measurement point and is used to measure breast root width.

As shown in FIG. 1, which illustrates an embodiment of the devices disclosed herein, the first measuring strap 10 is preferably formed into a loop 60 secured preferably by holding member 30. More preferably, holding member 30 is a sliding buckle 30 or another structure or structures that permit(s) the circumference of loop 60 to be adjusted to be made smaller or larger as needed so that the first measuring strap can easily be shortened and lengthened by the user in order to achieve a snug fit around the part of the person being measured using the device.

The device preferably comprises two complementary interlocking members 40 and 50 that can be removably locked or linked to one another, to secure first measuring strap 10 around the ribcage or other portion of the person being measured. The interlocking members may be chosen from any mechanism that can maintain the interlocked or joined position without unlocking or disengaging from one another unless and until the user intentionally releases or disengages the interlocking members, and provided that they do not block or obscure the first measurement indicia 18. Non-limiting examples of interlocking members are hook and eye fasteners, Velcro®, side release buckles, center release buckles, magnetic clasps, etc. Preferably, member 50 is moveable along the entire loop 60. Illustrated in FIG. 1 is an embodiment wherein first interlocking member 40 is at the first end 12 of strap 10, and second interlocking member 50 is retained on and moveable on loop 60 so that it cannot fall off first measuring strap 10. When the device is in use, members 40 and 50 are linked together by the user, so as to permit band measuring strap 10 to snugly fit against the skin of and encircle the ribcage (or other area being measured) of the person getting measured.

Interlocking members 40 and 50 stay linked to one another until they are intentionally unlinked or disengaged them from one another. Members 40 and 50 may be readily unlinked or disengaged when desired. Preferably, interlocking members 40 and 50 do not prevent the person using the device from reading the first measurement indicia 18, such as by obscuring the indicia 18. The specific shape of members 40 and 50 is not critical, provided that they are able to interlock (e.g., link) with one another and remain interlocked or linked to one another until the user of the device wishes to unlink or disengage them from one another.

In an example of a preferred embodiment, first interlocking member 40 is in the shape of a triangle. In yet another preferred embodiment, second interlocking member 50 is substantially in the shape of a circle or in the shape of a partial circle, such as a D ring. To facilitate linking member 40 and member 50 to one another, they may be provided with a hook or other projection that engages with and locks on to the other member. In one preferred embodiment, member 50 has a J-hook (a hook substantially in the shape of the letter "J") for linking with the triangle-shaped member 40. In another embodiment, either member 40 or member 50 is provided with a hook or other linking projection to facilitate linking of member 40 to member 50. In still yet another embodiment, both members 40 and 50 are provided with hooks or other linking projections to facilitate linking to one another.

Figure 3A:
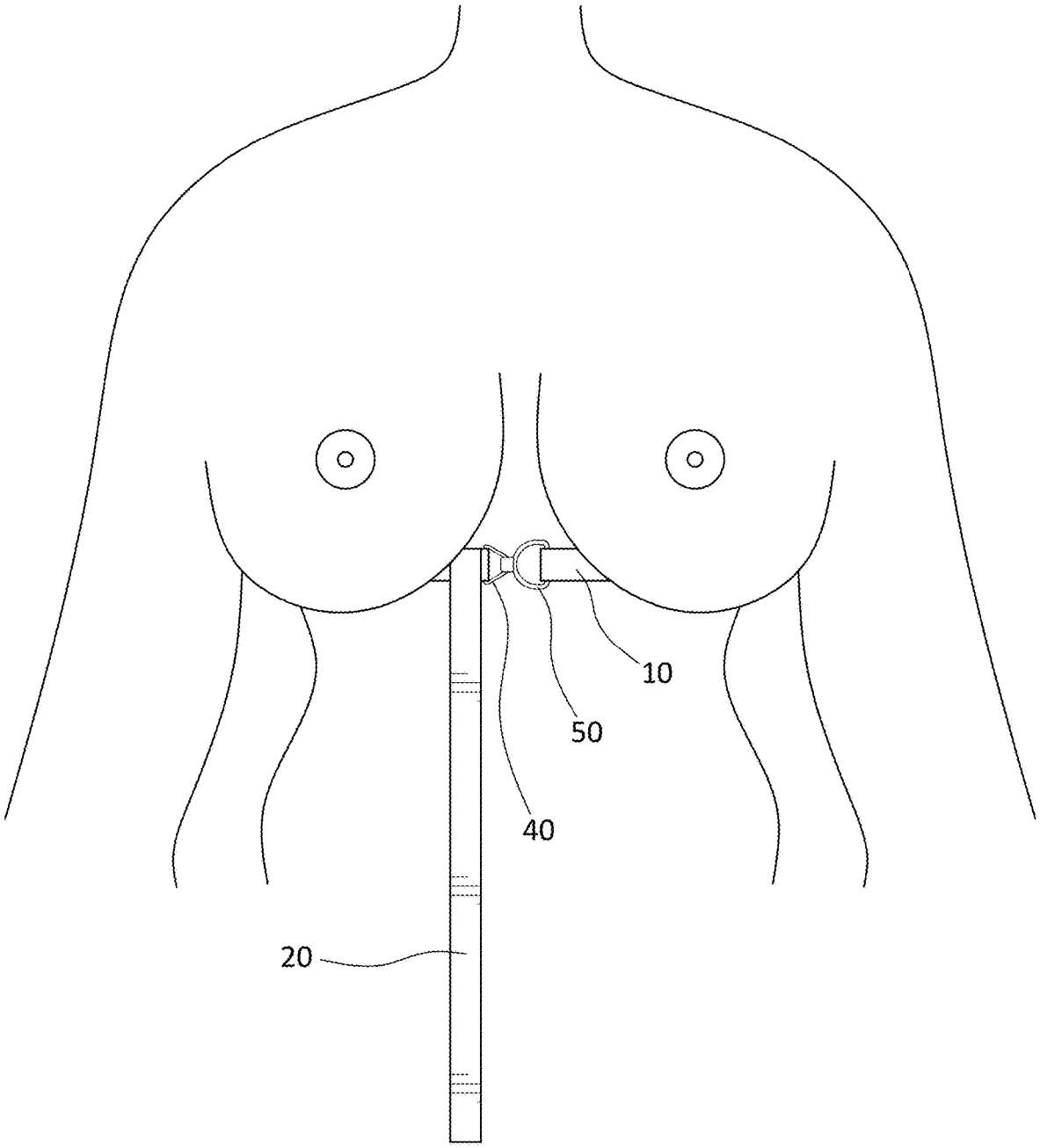
FIGS. 3A, 3B, and 3C illustrate a method of using an embodiment of the devices described herein to measure a person's band size.
Figure 3B:
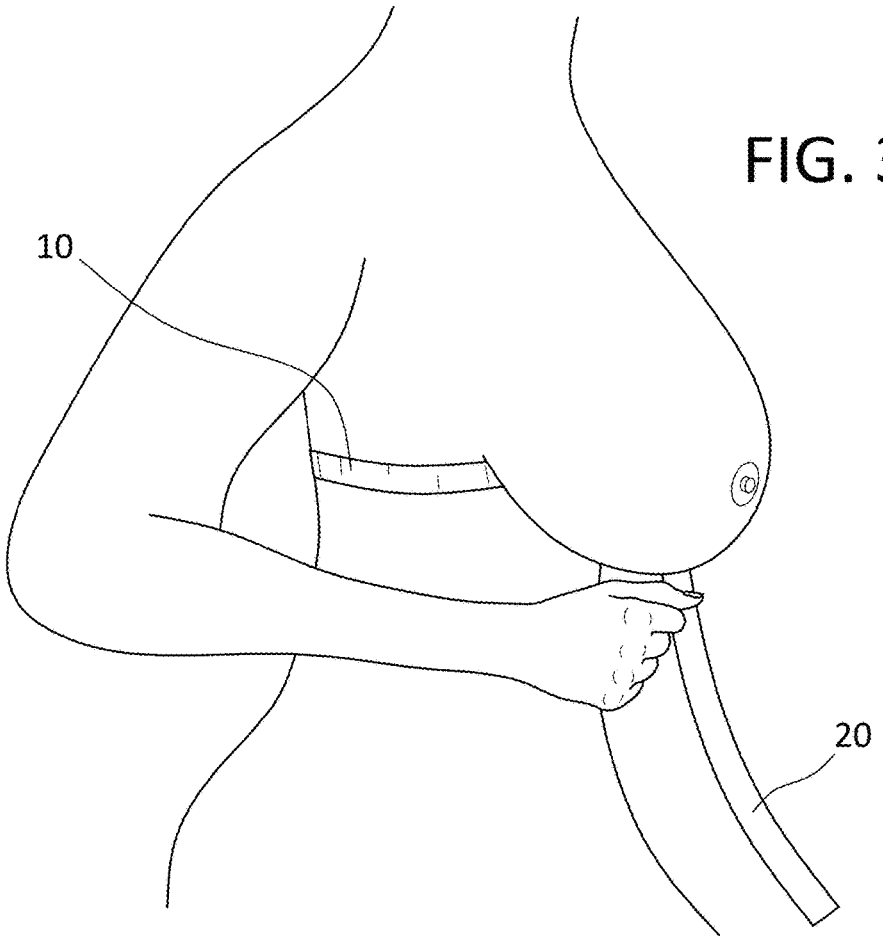
Figure 3C:
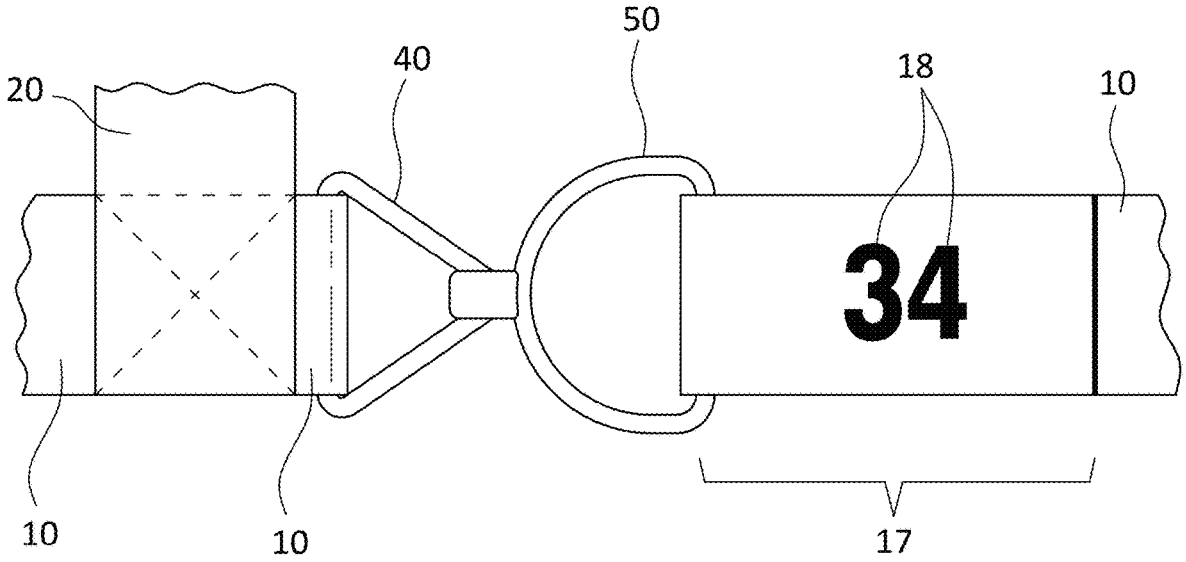

In one of the preferred embodiments shown in FIGS. 3A-3C, first interlocking member 40 is triangle-shaped, permitting the user to readily connect it with the ring-shaped or D-ring shaped second interlocking member 50, wherein either member 40 or 50 has a hook or other appendage or means for engaging the other member 40 or 50.

Preferably, a portion of said band measuring strap 10 forms a loop 60, and loop 60's circumference is adjustable, thereby permitting a user of the device to increase and decrease the length of the strap 10. More preferably, loop 60 is comprised of holding member 30 slidably disposed on strap 10. The loop 60 is created by inserting the second end 14 of band measuring strap 10 into holding member 30 on strap 10. Preferably, loop 60 is formed prior to attaching strap 10 and strap 20 to one another. Preferably, holding member 30 is a sliding buckle.

Sliding buckle 30 is preferably comprised of two horizontal end portions and 3 vertical cross pieces. The terms "horizontal" and "vertical" are used herein only to describe the parts of sliding buckle 30 in relation to one another. Loop 60 is preferably assembled as follows. The second end 14 of strap 10 is inserted into buckle 30 and then second end 14 of strap 10 is folded over and around the center vertical cross piece of buckle 30, to form a small loop, and then the loop is secured around the center vertical cross piece of buckle 30 by sewing, welding, gluing, or other suitable means to secure to one another the portions of strap 10 forming the small loop. Next, second complementary interlocking member 50 is threaded onto strap 10, and then the first end 12 of strap 10 is threaded over and around the center vertical cross piece of buckle 30, and over and around the small loop. thereby forming a larger loop 60 comprised of a portion of strap 10.

A portion of strap 10 and a portion of strap 20 are attached together at first end 12 and second end 14, respectively, at a substantially 90 degree angle relative to one another, preferably by sewing, welding, gluing, or other suitable means. In a preferred embodiment, first interlocking member 40 is secured to strap 10 at its first end 12. More preferably, member 40 is secured or attached to strap 10 as follows: second end 12 of strap 10 is folded over and around a portion of member 40, thereby forming a small loop that traps a portion of 40 in the small loop, and the loop is secured around the portion of member 40 by sewing, welding, gluing, or other suitable means to secure to one another the portions of strap 10 forming the loop around the portion of member 40. Concurrently with, or subsequent to, securing the small loop, second end 24 of strap 20 is substantially permanently secured at a substantially 90 degree angle to first end 12 of strap 10. In a preferred embodiment, second 24 and first end 12 are secured to one another substantially simultaneously and at a 90 degree angle, by sewing.

The particular measurement indicia 18, 26, and 28 illustrated in the drawing figures are preferred, but other types and units of measurement indicia may be used.

Figure 5:
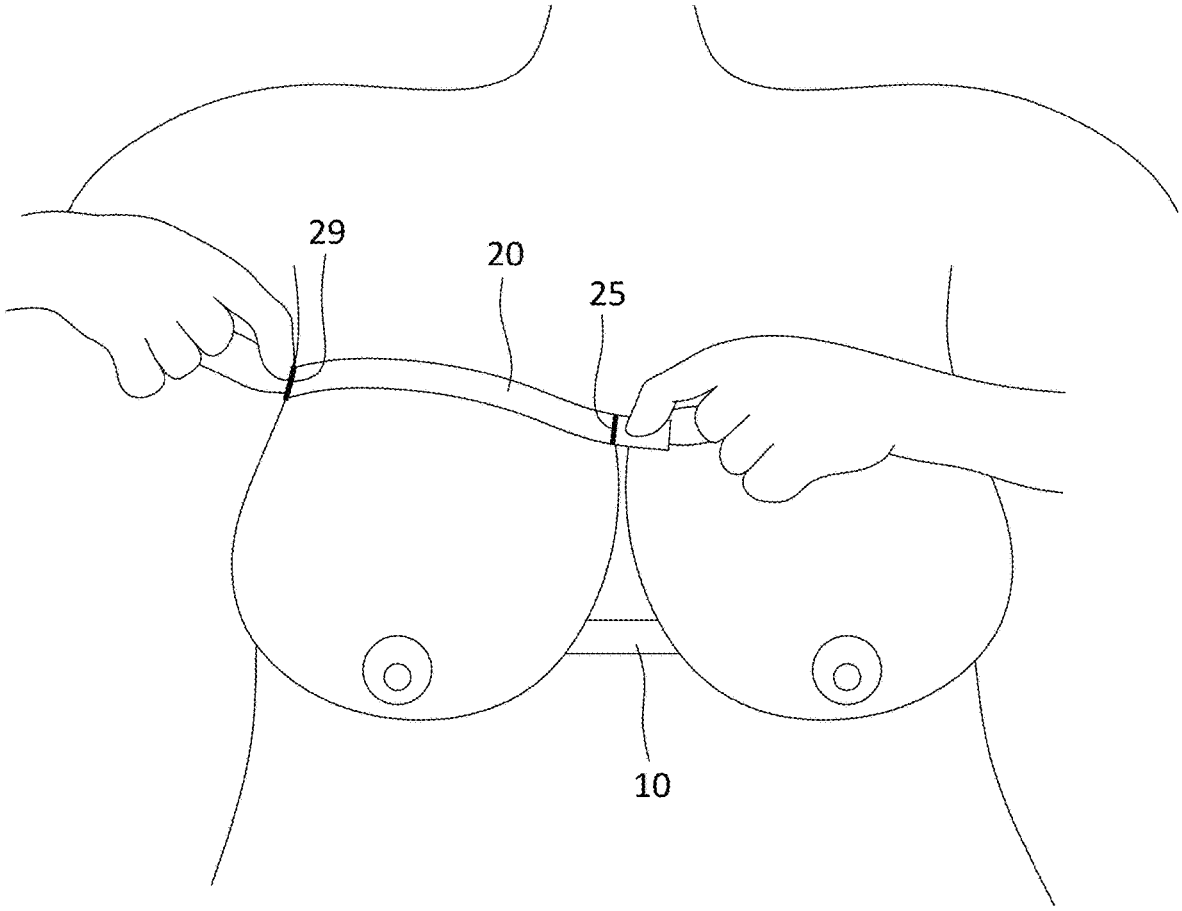
FIG. 5 illustrates a method of using an embodiment of the devices described herein to measure a person's breast root width size.

Band measurement point 17 refers to the point on strap 10 where the band size measurement is read, and is illustrated in FIG. 3C. Cup measurement point 27 refers to the point on strap 20 at the center of the nipple on the breast being measured and is illustrated in FIGS. 4A and 4B. Breast root width measurement point 29 refers to the point on strap 20 where the breast being measured ends under the person's armpit, and is illustrated in FIG. 5.

The devices described herein may be comprised of two linear, substantially planar, flexible straps: a first measuring strap 10, and a second measuring strap 20. Straps 10 and 20 are joined together at a substantially 90 degree angle to one another, and do not move relative to one another at the point at which they are joined. Preferably, straps 10 and 20 are joined together by heat welding, ultrasonic welding, or sewing, or a combination thereof.

Figure 2A:
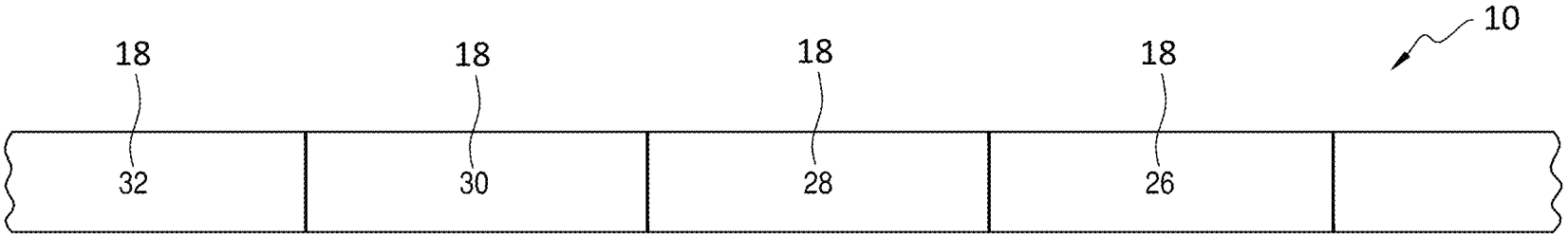
FIGS. 2A, 2B, and 2C are views of portions of an embodiment of the devices described herein, showing non-limiting examples of potential measurement indicia units that may be used.
Figure 2B:
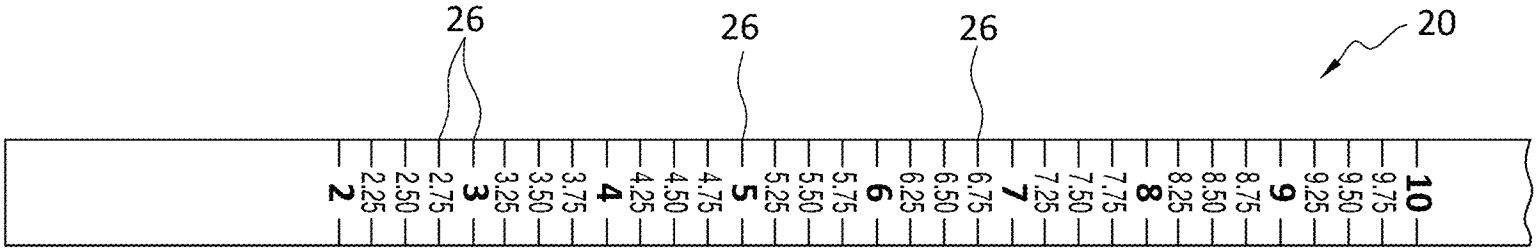
Figure 2C:
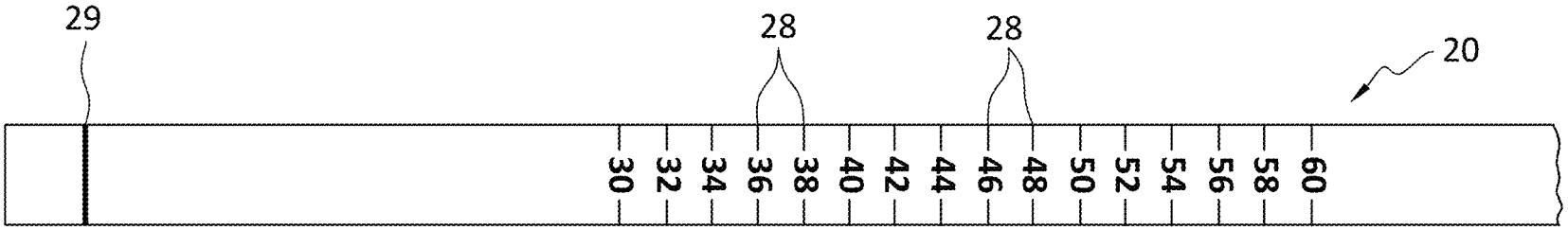

Most of the drawing figures show the first measuring strap 10 and the second measuring strap 20 without their respective measurement indicia. An embodiment of the measurement indicia is illustrated in FIGS. 2A, 2B, and 2C. Shown in FIG. 1 are areas (A, B, C) of the straps 10 and 20 generally corresponding to where the respective measurement indicia are located. In FIG. 1 a portion of first measuring strap 10 is labeled with an "A", wherein A corresponds to the location of the first measurement indicia 18 shown in FIG. 2A. In FIG. 1 the portion of the second measuring strap 20 labeled "B" corresponds to the location of the second measurement indicia 26 shown in FIG. 2B, and the portion labeled "C" corresponds to the location of the third measurement indicia 28 shown in FIG. 2C. The figures show only a portion of the indicia that may be present on the device. For example, FIG. 2C illustrates only a portion of strap 20 and a portion of the measurement indicia 18. The particular measurement indicia illustrated in the drawing figures are preferred, but other units of measurement and indicia may be used.

To use device 1 to measure the person's ribcage/breast area, the user (who may be the person measuring themselves or a person assisting the person being measured) holds in one hand interlocking member 40 which is at strap 10 near its first end 12, and holds in the other hand interlocking member 50, wraps strap 10 around the ribcage just below the breasts of the person being measured, and joins (i.e., links or interlocks) members 40 and 50. The user slides member 50 so that it is as far away from holding member 30 as possible, which is the fully extended position of loop 60. The proper snug fit of strap 10 on the person's body is obtained by making strap 10 shorter or longer, by sliding holding member 30, thereby making loop 60 larger or smaller. The smaller that the circumference of loop 60 is, the longer the length of strap 10, and conversely, the larger the circumference of loop 60, the shorter the length of strap 10.

Preferably, the devices described herein are used to measure a person when the person is not wearing any clothes or undergarments.

The devices described herein are especially useful for determining a person's correct bra band size measurement, cup size measurement, and wire size measurement, in accordance with the following steps:

(a) measuring the person's bra band size by placing the first measuring strap aka band measuring strap 10 around the person's torso at a point immediately below the person's breasts until the strap 10 is snug against the person's ribcage; interlocking the first complementary interlocking member 40 and the second complementary interlocking member 50; and reading the measurement indicum at a band measurement point 17, as illustrated in FIG. 3C;

(b) measuring cup size by retaining band measuring strap 10 around the person's ribcage at a point immediately below the breasts, and rotating strap 10 around the ribcage, and wherein second measuring strap aka cup and breast root width measuring strap 20 (which is at about a 90 degree angle relative to strap 10) is directly below the person's nipple, and conforming the cup and breast root width measuring strap 20 against the breast from the torso to the person's nipple; and reading the measurement indicum at the center of the nipple which is cup measurement point 27; and (c) measuring breast root width size by retaining the band measuring strap 10 around the person's ribcage in an orientation substantially parallel to the ground or floor, then placing a guide line 25 situated on strap 20 on a breast at the person's cleavage and conforming the strap 20 across the top of the breast to point where the breast ends at the person's armpit, and reading the measurement indicum at breast root width measurement point 29.

The band, cup, and breast root width measurement indicia on the straps can be numerical or non-numerical.

To make sure that strap 10 is snug but not too tight around the person's ribcage, the person (or another person assisting the person being measured) may loosen or tighten the fit of strap 10 by making it smaller or larger in circumference. One preferred method is to adjust strap 10 by increasing or decreasing the circumference of loop 60 by sliding holding member or buckle 30 along strap 10.

A method of using the device to determine a person's correct bra band measurement is illustrated in FIGS. 3A, 3B and 3C. As shown in FIGS. 3A and 3B, the person remains standing throughout the time loop 60 is placed around the person's naked (undressed) torso at the ribcage, at a point just under (immediately below) the breasts, and loop 60 is adjusted so that strap 10 fits snugly around the ribcage, by using a slider or buckle 30 that is slidably disposed on strap 10 and loop 60. As used herein, the phrase "snugly" or "snug" means that strap 10 stays in place on the person's body around their ribcage, without pressing too tightly and uncomfortably into the person's flesh.

The strap 10 is placed so that the meeting point of interlocking members 40 and 50 is at a point midway between the breasts. The person's bra band measurement is determined by the number (the indicia) that appears on strap 10 next to member 50. This is illustrated in FIG. 3C which is a close-up view of the device being used in FIG. 3A, and indicates that the person's bra band measurement indicia 18 is read as "34".

The person can often read the bra band measurement indicia 18 by bending their head slightly forward and down. If bending in this manner is not possible or is difficult, the person can look in a mirror to see the bra band measurement indicia 18. Yet another potential way for the person to see the bra band measurement indicia 18 while the device is in place on the person's torso is to use a mobile phone or camera to take a photograph or video, or by using a mirror app on the phone, to visualize the indicia 18.

If the person finds it difficult to read the band measurement while the device 1 is in place on the person's torso, the device can be taken off the person by unlinking or disengaging interlocking members 40 and 50 from one another, making sure that members 40 and 50 are at opposite ends of strap 10, and reading the band measurement indicia 18 number that appears at band measurement point 17 on strap 10 adjacent to interlocking member 50. If this method is used, the band measurement strap 10 is thereafter replaced on the person's torso before proceeding to the steps of measuring the person's cup size and breast root width size.

A method of using the device to determine a person's correct bra cup measurement is illustrated in FIGS. 4A and 4B. As with the method for measuring band size, the person remains standing throughout, and strap 10 is snugly secured around the person's naked (undressed) torso at the ribcage, at a point just under (immediately below) the breasts, and loop 60 is adjusted as needed, so that strap 10 fits snugly around the ribcage. Band measuring strap 10 is rotated so that the second complementary interlocking member 50 is located at a point immediately below the nipple of one breast. Then, the cup and breast root width measuring strap 20 is conformed against the breast from the torso to the person's nipple; and the numerical measurement is read at the nipple, which is cup measurement point 27.

An alternative method to determine bra cup measurement, particularly for persons with large breasts is for the person, after snugly securing the band measuring strap 10 around their waist, to bend over at the waist, so that the person's torso and ribcage are substantially parallel to the floor. Band measuring strap 10 is rotated so that the first complementary interlocking member 40 is located at a point immediately below the nipple of one breast. Then, the cup and breast root width measuring strap 20 is conformed against the breast from the torso to the person's nipple, and the numerical measurement is read at the nipple, which is the cup measurement point 27.

Another alternative variation of the method for determining bra cup measurement, particularly if the person is not able to or uncomfortable with standing still, is for the person to sit down before bending over at the waist. Once in the sitting position, the person may spread their knees apart so that they can place their torso/ribcage in a position substantially parallel to the floor. Loop 60 is rotated so that the first complementary interlocking member 40 is located at a point immediately below one breast, and wherein strap 20 is positioned directly below the nipple on that breast. Then, the cup and breast root width measuring strap 20 is conformed against the breast from the ribcage to the person's nipple, and the numerical measurement is read at the center of the nipple, i.e., cup measurement point 27.

Optionally, all or a portion of the cup and breast root width measuring strap 20 can be made of a transparent or substantially transparent material, to facilitate the ability of the person using the device to see the person's nipple through strap 20 when measuring the person's cup size.

FIG. 5 illustrates a method of using the device to determine a person's correct breast root width measurement, which optionally can be used to determine the correct size underwire for the person. With the person standing and with band measuring strap 10 snugly secured around the person's naked torso at the ribcage (or alternatively, without strap 10 secured on the person's torso), the guide line 25 on the cup and breast root width measuring strap 20 is placed on one of the person's breasts at the point where the breast begins on the cleavage side of the breast, at the point where the breast meets the torso. Then, the strap 20 is conformed, in an orientation substantially parallel to the floor of the room, across the top of the breast to a point where the breast ends at the person's armpit. Then one reads the numerical measurement at breast root width measurement point 29, which is the point where the breast ends, thereby providing the person's breast root width measurement.

Due to the fact that it is common for each of a person's breasts to be of a different size, ideally a person will use the device to take a cup measurement and breast root width measurement for each breast. In such a case, the person should choose a bra size using the larger breast's cup and breast root width measurements, unless a ready-made bra is available wherein each cup and each portion corresponding to the breast root width measurement conform specifically to each of the person's different-sized breasts. Alternatively, a bra can be custom-made wherein each cup and each breast root width conform to each of the person's different sized breasts.

The devices described herein may be used to measure the length and/or circumference of various areas of the body, such as the circumference of the person's hips, the circumference of the person's waist, the length of the person's torso, the longitudinal circumference of the person's torso, the length of the person's leg, the person's inseam, etc. For example, a first measuring strap 10 may be used to measure the hips or waist by the user holding in one hand interlocking member 40 and in the other hand interlocking member 50, and wrapping strap 10 around the hips or waist, obtaining a snug fit by making strap 10 longer or shorter by sliding holding member 30, thereby making loop 60 larger or smaller until the snug fit is achieved. During the aforementioned process, the user joins (links or interlocks) members 40 and 50, to snugly secure strap 10 on the body.

Unless defined otherwise, all technical and scientific terms used herein have the same meaning as commonly understood by persons having ordinary skill in the art to which the invention pertains. Although any methods and materials similar or equivalent to those described herein can be used in practice for testing of the present invention, the preferred materials and methods are described herein.

In understanding the scope of the present invention, the articles "a" and "an" are used herein to refer to one or to more than one (i.e., to at least one) of the grammatical object of the article. By way of example, "an element" means one element or more than one element. The term "comprising" and its derivatives, as used herein, are intended to be open ended terms that specify the presence of the stated features, elements, components, groups, and/or steps, but do not exclude the presence of other unstated features, elements, components, groups, and/or steps. The foregoing also applies to words having similar meanings such as the terms, "including," "having" and their derivatives. Any terms of degree such as "substantially," "about" and "approximate" as used herein mean a reasonable amount of deviation of the modified term such that the end result is not significantly changed. When referring to a measurable value, such as an amount, a temporal duration, and the like, these terms are meant to encompass variations of at least ±20% or ±10%, more preferably ±5%, even more preferably ±1%, and still more preferably ±0.1% from the specified value, as such variations are appropriate and as would be understood by persons having ordinary skill in the art to which the invention pertains.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adapted to another embodiment. It should be noted that while the present invention is shown and described herein as it could be used in conjunction with a configuration of various components, it could be utilized with other configurations, either now known in the art or that may be developed in the future, so long as the objects and features of the invention are achieved, as would become apparent to persons having ordinary skill in the art after having become familiar with the teachings provided herein. Consequently, the present invention should not be regarded as limited to that shown and described herein. It is not necessary for all advantages to be present in a particular embodiment at the same time. Thus, the foregoing descriptions of the embodiments according to the present invention are provided for illustration only, and not for the purpose of limiting the invention as defined by the appended claims and their equivalents.

Having herein set forth preferred embodiments of the present invention, it is anticipated that suitable modifications can be made thereto which will nonetheless remain within the scope of the invention. The invention shall therefore only be construed in accordance with the following claims.

What is claimed is:

1. A device for measuring a portion of a person's body, comprising:

a first measuring strap (10) having a first end (12), a second end (14), a first measurement indicia (18), a loop (60) formed by a holding member (30) disposed on said first measuring strap (10);

a first interlocking member (40) at said first end (12);

a second measuring strap (20) having a first end (22), a second end (24), a guide line (25), a second measurement indicia (26), and a third measurement indicia (28); and a second interlocking member (50) moveably disposed on said first measuring strap (10) and contained on said loop (60);

wherein the first end (12) of said first measuring strap (10) and the second end (24) of said second measuring strap (20) are attached at a substantially 90-degree angle relative to one another.

2. The device of claim 1, wherein the loop (60) circumference is adjustable.

3. The device of claim 2, wherein the holding member (30) is a sliding buckle.

4. The device of claim 3, wherein loop (60)'s circumference is adjustable by sliding holding member (30) along first measuring strap (10).

5. The device of claim 4, wherein an increase in the loop (60) circumference results in an increase in strap (10) length, and a decrease in loop (60) circumference results in a decrease in strap (10) length.

6. The device of claim 5, wherein the interlocking members (40) and (50) releasably interlock with one another.

7. The device of claim 6, wherein said second interlocking member (50) is substantially circular.

8. The device of claim 6, wherein said second interlocking member (50) is a D-ring.

9. The device of claim 6, wherein said first interlocking member (40) is substantially triangular.

10. The device of claim 6, wherein said first member (40) is triangular and said second member (50) is circular, and one or both members are provided with a projection for interlocking.

11. The device of claim 6, wherein the first end (12) of said first measuring strap (10) and the second end (24) of said second measuring strap (20) are attached with one or more stitches, one or more heat welds, one or more ultrasonic welds, glue, or a combination thereof.

12. The device of claim 6, wherein said first measuring strap (10) is a band measuring strap, and said second measuring strap (20) is a cup and breast root width measuring strap.

13. The device of claim 12, wherein said second measuring strap (20) is comprised of at least two straps each attached at a substantially 90 degree angle to said first measuring strap (10).

14. A method for measuring a person's body using the device of claim 11, comprising the steps of (a) measuring a person's torso's circumference by placing the strap (10) around a person's torso at a point immediately below a person's breasts until said strap (10) fits snugly against the person's ribcage; interlocking the first interlocking member (40) and the second interlocking member (50); and reading a measurement indicum at a band measurement point (17); (b) measuring a person's breast's cup size by rotating the strap (10) so that the strap (20) is directly below a nipple on a person's breast, and conforming the strap (20) against the breast from the person's ribcage to the nipple; and reading a measurement indicum at a cup measurement point (27); and (c) measuring a person's breast root width size by placing guide line (25) on strap (20) onto the person's breast where the breast begins at a person's cleavage, conforming the strap (20) across the breast, and reading a measurement indicum at breast root width measurement point (29).

15. The method of claim 14, wherein step (a) further comprises adjusting the strap (10) length by adjusting the loop (60) circumference.

16. The method of claim 15, further comprising using the device to measure a part of the person's a body other than the person's breast.

17. The method of claim 16, further comprising using the device to measure the person's waist size, hip size, leg length, inseam arm length, or longitudinal torso circumference.

* * * * *